US005318083A

United States Patent [19]

Gönner et al.

[11] Patent Number: 5,318,083

[45] Date of Patent: Jun. 7, 1994

[54] APPARATUS FOR CUTTING AND SEVERING OF A THIN BOARD FROM SQUARED TIMBER

[75] Inventors: Siegmar Gönner, Oberkirch; Heinz-Hubert Braun, Oberkirch-Bottenau, both of Fed. Rep. of Germany

[73] Assignee: Firma Gebruder Linck Machinenfabrik "Gatterlinck" GmbH & Co., KG, Oberkirch, Fed. Rep. of Germany

[21] Appl. No.: 826,818

[22] Filed: Jan. 28, 1992

[30] Foreign Application Priority Data

Jan. 30, 1991 [DE] Fed. Rep. of Germany ..... 4102664
Jan. 25, 1992 [DE] Fed. Rep. of Germany ... 92101218.3

[51] Int. Cl.[5] ..... B27L 5/06; B27C 1/00

[52] U.S. Cl. ..... 144/175; 144/120; 144/130; 83/870

[58] Field of Search ..... 83/874, 870, 422; 144/175, 120, 130, 178

[56] References Cited

U.S. PATENT DOCUMENTS 1,644,961 10/1927 Suttis et al. .
1,828,873 10/1931 Miller .
3,783,917 1/1974 Mochizuki ..... 144/175
4,089,354 5/1978 Cremona ..... 144/178
5,010,934 4/1991 Mochizuki et al. ..... 144/175

FOREIGN PATENT DOCUMENTS 1227961 10/1987 Canada .
51933 5/1890 Fed. Rep. of Germany .
73544 2/1894 Fed. Rep. of Germany .
238774 10/1911 Fed. Rep. of Germany .
0506080 8/1930 Fed. Rep. of Germany ..... 144/120
3926396 2/1991 Fed. Rep. of Germany .
4029752 8/1991 Fed. Rep. of Germany .
4038486 6/1992 Fed. Rep. of Germany .
2312340 12/1976 France .

*Primary Examiner*—Richard K. Seidel
*Assistant Examiner*—Allan M. Schrock
*Attorney, Agent, or Firm*—Marshall, O'Toole, Gerstein, Murray & Borun

[57] ABSTRACT

An apparatus for severing thin boards from squared timber includes a guide surface upon which a squared timber is conveyed and pressed against a cutting edge of a blade, as well as a counter pressing edge. The adjustment of the distance between the guide surface and a plane parallel thereto which extends through the blade cutting edge (i.e., the thickness of the thin board to be cut) is effected by relative adjustment of the blade cutting edge to the guide surface in an inclined plane which forms an acute adjustment angle α with a line normal to the guide surface. Because of the relative adjustment of the blade cutting edge to the guide surface along the angle α, when a different board thickness is desired, the distance between the blade cutting edge and the counter pressing edge in the cutting direction is automatically adapted. In a preferred embodiment of the apparatus, the width of an exit guide channel for the severed thin boards can also be simultaneously set to the desired board thickness.

11 Claims, 2 Drawing Sheets

APPARATUS FOR CUTTING AND SEVERING OF A THIN BOARD FROM SQUARED TIMBER

DESCRIPTION

The invention relates to an apparatus for cutting and severing a thin board from squared timber. More particularly, the invention relates to an apparatus comprising a guide surface adapted for conveying longitudinally oriented squared timber, a blade having a cutting edge and being disposed behind the guide surface with respect to the direction of conveyance of the timber, and a counter pressing edge disposed at an end of the guide surface facing the blade cutting edge. The blade cutting edge is disposed at an angle to the direction of conveyance of the timber and also lies in a plane disposed an adjustable distance from and parallel to the guide surface. This adjustable distance corresponds substantially to the thickness of the board to be severed. The pressing edge of such an apparatus is disposed parallel to the blade cutting edge and to the guide surface. If necessary, the pressing edge may project slightly out of the guide surface plane. Finally, such an apparatus includes adjusting means for varying the distance between the guide surface and the parallel plane containing the blade cutting edge.

An apparatus of this type is described for example in DE-A-39 26 396, the disclosure of which is incorporated herein by reference.

The guide surface against which a squared timber to be worked is pressed whilst it is advanced in its longitudinal direction as conveying direction against the following blade can fundamentally be arranged in any desired alignment. It has however been found expedient to arrange the guide surface horizontally so that the squared timber lies thereon whilst it is pushed forwardly against the blade.

A blade must necessarily have a finite wedge angle originating from the blade cutting edge and for this reason a board to be severed by cutting from squared timber cannot also be withdrawn in the direction of the feed movement of the squared timber but must be led off inclined laterally corresponding to the wedge angle of the blade. Now, the blade can be arranged in such a manner in the apparatus that its substantially smooth blade back extends in spaced parallel relationship to the guide surface, and forms a further support for the squared timber reduced in thickness by the cut-off board, the wedge surface of the blade then serving as surface for carrying away the severed board. In the sense of this description the acute angle at which the wedge-shaped exit guide surface of the blade extends to the blade back or guide surface is referred to as exit guide angle. The blade installation may however fundamentally also be a converse arrangement so that the wedge surface of the blade extends parallel to the guide surface and forms a further support for the squared timber reduced in thickness, and the blade back serves as exit guide surface. However, in such an arrangement generally in a continuation of the wedge surface of the blade a support surface lying in the same plane is to be provided on the blade carrier for the reduced squared timber so that the latter is also adequately supported on its further advancing movement behind the blade.

At the side of the squared timber opposite the blade apparatuses of the type concerned here comprise pressing means with which the squared timber is pressed against the guide surface and the blade and in addition feed means are provided and with the aid thereof the squared timber is driven in the conveying direction against the blade. These parts of an apparatus, which are not directly affected by the present invention, are presumed known and the person skilled in the art familiar therewith.

In this respect attention is drawn for example to DE-A-40 38 486, the disclosure of which is incorporated herein by reference.

The pressure edge arranged at the end of the guide surface and disposed in front of the blade, said edge generally being elevated somewhat above the guide surface, serves to exert an additional counter pressure on the squared timber which is intended to prevent an uncontrolled splitting off of the board by the blade. Since the squared timber is generally pressed against the guide surface and the blade back, the projecting pressure edge penetrates into the wood somewhat. Since however, due to the at least partially resilient properties of the wood, after severing of the board this depression essentially recovers again, the thickness of the board is governed substantially by the distance between the guide surface and the plane extending through the blade cutting edge parallel to the guide surface.

The thickness of the board to be cut off is preselected in that the distance between the guide surface and the plane containing the blade cutting edge is varied in that for example in a machine with a horizontally extending guide surface either a support table carrying the guide surface or the blade carrier is adjusted in a direction perpendicularly to the guide surface relatively to the stationary machine frame. With horizontal arrangement of the guide surface this is a pure vertical adjustment of one of these two machine assemblies.

For simplification, hereinafter the description will proceed from a machine having a support table with horizontal guide surface for the squared timber.

The pressing edge arranged in front of the guide surface, as already mentioned, is disposed parallel in front of the blade cutting edge. This means that the vertical projection of the blade cutting edge onto the extended imaginary guide surface has a certain horizontal distance from the pressing edge. To obtain optimum and constant cutting conditions this horizontal distance must be varied in accordance with the thickness of the boards to be produced in such a manner that it is increased with increasing board thickness to enable the board being cut off to be transferred to its exit direction with adequate bending ratio. On the other hand, the pressing edge should lie as close as possible to the blade to avoid the splitting effect already mentioned. It is therefore additionally necessary with a varied thickness setting to vary the horizontal distance between the blade cutting edge and the pressing edge as well. Finally, with a changed thickness setting it may also be necessary to change the elevation of the pressing edge above the guide surface so that a total of three distance adjustments may be necessary to the machine to adapt the latter to a modified board thickness.

Since in apparatuses of the type concerned here the blade cutting edge generally lies at an acute angle to the conveying direction of the wood, the respective severed board additionally undergoes a twisting on its lateral removal along the exit guide surface. It has bene found that additional straightening means for cancelling this twisting can generally be dispensed with if a support surface is arranged opposite the exit guide surface behind the pressing edge with a spacing corresponding to the board width, said support surface forming together with the exit guide surface a channel for carrying away the severed board which occupies at least a certain distance behind the blade cutting edge and the pressing edge. Since the exit guide channel extends at an angle to the guide surface, when setting the machine to another board thickness by vertical adjustment for example of the guide surface the vertical adjustment is not transmitted in absolute magnitude to the distance between the exit guide surface and support surface and consequently when setting the machine to another thickness the exit guide channel for the severed board must also be specially set by changing the distance of the support surface from the exit guide surface. This would be a fourth adjustment necessary on changing the board thickness in known machines.

The invention is based on the problem of improving an apparatus of the type mentioned at the beginning in such a manner that on changing the board thickness setting the minimum possible adjustments of the apparatus are necessary.

This problem is solved generally by an apparatus having an adjusting means being adapted to effect a parallel displacement of the blade cutting edge or the counter pressing edge in an adjustment plane which forms an acute adjustment angle ($\alpha$) with a line disposed normal to the guide surface.

For it has been found that the horizontal distance between the blade cutting edge and pressing edge must be changed substantially proportionally to the board thickness adjustment. This horizontal distance between the blade cutting edge and pressing edge should lie in the range between about 0.05 times and 0.2 times the board thickness. Preferred spacings are between 0.1 times and 0.15 times the board thickness. If the operations are carried out with a constant factor int his respect, by an inclined adjustment according to the invention it is possible to achieve that on changing the board thickness setting of the apparatus the distance between the blade cutting edge and pressing edge is also correspondingly correctly adapted. This results in adjustment angles in the range between about 3 and 15 angular degrees, preferably between 5 and 12 angular degrees.

Since the wedge angle of an conventional blade is about 20 angular degrees and said wedge angle forms the exit guide angle of the severed board, a separate adjustment of the exit guide channel between exit guide surface and support surface may additionally be avoided if the adjustment angle corresponds substantially to half the exit guide angle, which with a blade wedge angle of 20° corresponds to an angle of 10°, this falling in the preferred range for the adjustment angle. For in this case the adjustment direction extends along the angle by sector of the obtuse angle between the support surface and the exit guide surface. An adjustment in this direction effects that the vertical distance between the guide surface and blade cutting edge plane changes in the same absolute amount as the distance between the exit guide surface and support surface of the exit guide channel. A separate adjustment of the width of the exit guide channel can thus be dispensed with.

In this manner, three different adjustments necessary when changing the board thickness in the apparatus can be combined into a single machine adjustment. Only the projection of the pressing edge beyond the guide surface will require a separate adjustment if necessary. This may however be done very simply in a preferred embodiment in that the pressing edge is mounted on a wedge element extending in the longitudinal direction thereof so that a relative longitudinal displacement between the pressing edge and said wedge element leads to an increase in height of the pressing edge. This adjustment can be effected by a very simple lateral spindle drive or an actuating cylinder because with a correspondingly shallow angle of the wedge element relatively large adjustment travels effect only a slight change in height of the pressing edge.

The inclined adjustment according to the invention between the blade and guide surface can be effected both by adjusting the support table carrying the guide surface and by a corresponding adjustment of the blade carrier.

Hereinafter the geometrical relationships will be explained further in detail with the aid of the attached drawings which relate to the area of the apparatus concerned here and in which.

Figure 1:
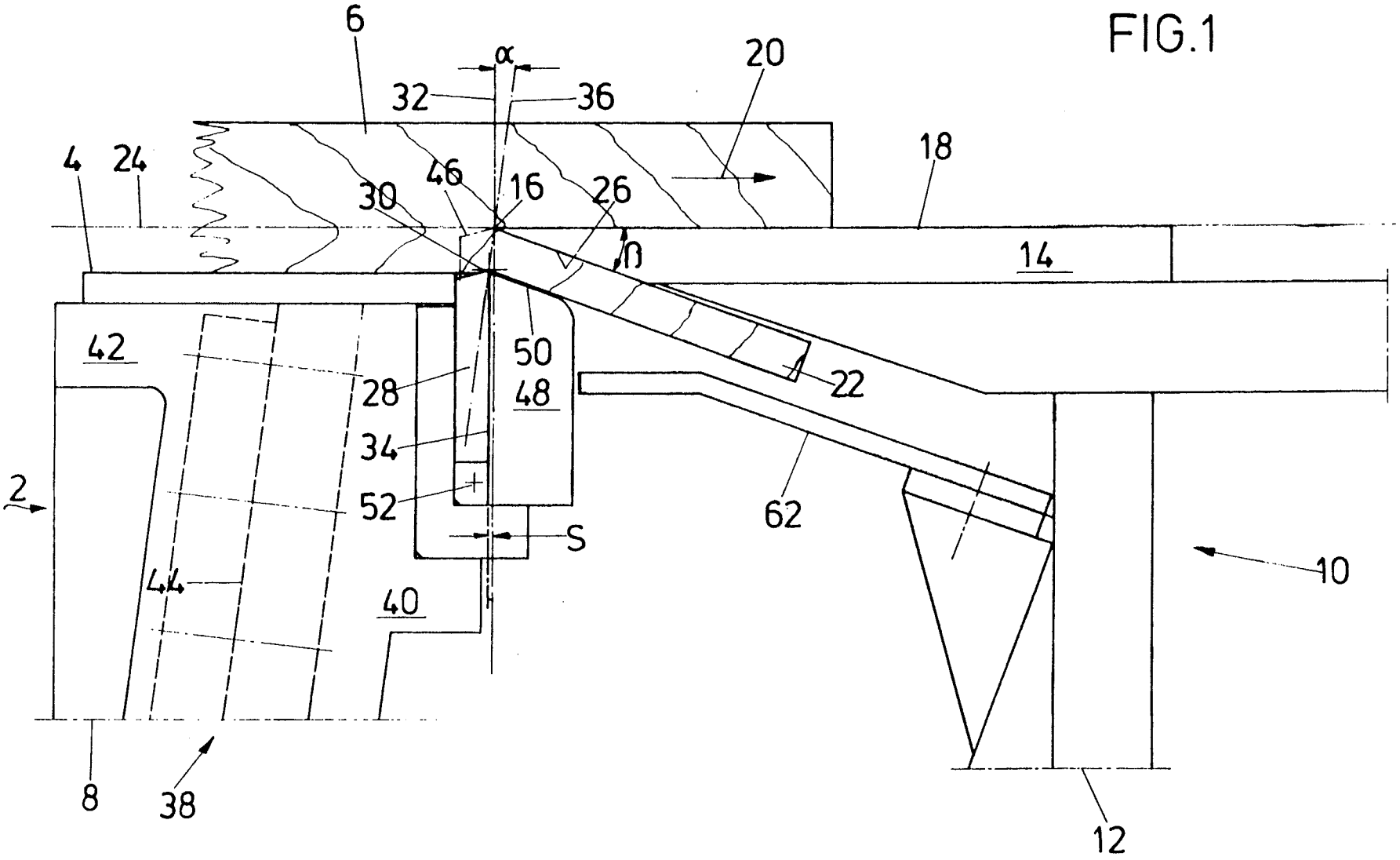
FIG. 1 shows an arrangement for an apparatus for cutting severing of a thin board from squared timber in which the support table comprising the squared timber guide surface is vertically adjustable in inclined direction.

The fragment illustrated in FIG. 1 of an apparatus for cutting severing of a thin board from squared timber shows a support table construction 2 of the apparatus which is provided at its upper side with a horizontal guide surface 4 for a squared timber or beam 6. The support table construction 2 is shown broken away along the line board where a stationary machine frame (not shown in detail) follows.

As further assembly the apparatus comprises a blade carrier construction 10 which is shown broken away along the line 12 and is there likewise connected to the stationary machine frame (not illustrated).

Resting on the blade carrier construction 10 in horizontal arrangement is a blade 14 having a cutting edge 16 and a back 18. The squared timber 6 is pressed by pressing means (not illustrated) against the guide surface 4 and the blade back 18 and is moved by feed means (not illustrated) in a conveying direction which is indicated by the arrow 20 against the blade cutting edge 16, a board 22 thereby being cut from the squared timber 6.

If it is assumed in the illustration in the drawings that the blade cutting edge 16 in the apparatus part shown schematically substantially in section is viewed as a live disposed perpendicularly to the plane of the drawing of FIG. 1, then the conveying direction 20 does not extend in the plane of the drawing but in the horizontal direction at an acute angle to the plane of the drawing because the blade cutting edge 16 forms in turn an acute angle with the conveying direction 20 in the apparatus. However, for simplicity the squared timber 6 has been shown as if it moved along the arrow 20 in the plane of the drawing to the right.

As can be seen, the squared timber 6 rests on the guide surface 4 before cutting off the board 22 whilst the squared timber reduced in thickness by the thickness of the board 22 is further moved along the back 18 of the blade 14. The blade cutting edge 16 lies in a plane 24 which is parallel to the guide surface 4 and the vertical distance of which from the guide surface 4 corresponds to the thickness of the board 22 between the major surfaces thereof. Originating from its cutting edge 16, the blade comprises between its back 18 and a wedge surface 26 a blade angle $\beta$ which in the example of embodiment is 20°. The wedge surface 26 is at the same time the exit guide surface for the separated board 22 which is therefore carried away downwardly inclined at an exit guide angle to the guide surface 4 which corresponds to the blade angle $\beta$.

A component 28 is connected to the support table construction 2 on the side thereof facing the blade 14 and is provided at its upper side with a pressing edge 30 which generally projects somewhat upwardly beyond the guide surface 4 and thus presses itself into the squared timber 6. If it is assumed that the blade cutting edge 16 extends perpendicularly to the plane of the drawing, then the pressure or pressing edge 30 will also extend perpendicularly to the plane of the drawing and parallel to the blade cutting edge 16. In the illustration int eh drawings, the line 32 extends as normal to the guide surface 4 through the blade cutting edge 16 whilst the perpendicular line 34 parallel thereto extends through the pressing edge 30. The distance s between the lines 32 and 34 is thus the distance between the blade cutting edge 16 and the pressing edge 30 in the horizontal direction. Furthermore, a line 36 is shown which extends at an angle $\alpha$ to the normal 32 to the guide surface 4. Said line 36 belongs in a plane which in the example of embodiment extends through the blade cutting edge 16 and the pressing edge 30.

The support table construction 2 is provided with vertical adjusting means 38 which are shown only schematically and with which a movable part 40 of the support table construction together with the guide surface 4 and the pressing edge 30 can be adjusted with respect to a frame-fixed part 42 of the support table construction along a plane 44. Said plane 44 extends parallel to the plane containing the line 36 which therefore forms an adjustment plane in which the pressing edge 30 can be adjusted at the angle $\alpha$ as adjustment angle and with it the guide surface can be adjusted in its vertical position for setting the board thickness of the machine.

If the board thickness setting is reduced to zero, the guide surface 4 and the pressing edge 30 are raised until the pressing edge is disposed at the blade cutting edge 16. If the pressing edge 30 in this embodiment is lowered along the line 36 inclined at the angle $\alpha$, the horizontal distance between the blade cutting edge 16 and the pressing edge 30 increases proportionally to the increasing board thickness distance between the plane 24 and the guide surface 4.

It is not absolutely essential for the adjustment plane 36 extending through the pressing edge 30 to extend through the blade cutting edge 16 as well so that the pressing edge 30 and the blade cutting edge 16 when set to the same vertical position substantially coincide; on the contrary, the adjustment plane 36 can be located so that it does not extend through the blade cutting edge 16 and consequently when the pressing edge 30 is raised to the vertical level of the blade cutting edge 16 a certain horizontal distance s still remains between the blade cutting edge and the pressing edge. The specific choice of the adjustment angle $\alpha$ and the position of the adjustment plane 36 is left to the discretion of the person skilled in the art.

In the illustration of FIG. 1, on the right of the component 28 having the pressing edge 30 there is a component 48 which is provided at its upper side with an inclined support surface 50 which extends parallel to the exit guide surface 26 and forms together with the latter an exit guide passage for the severed board 22. If the adjustment angle $\alpha$ is chosen in such a manner that it corresponds to half the exit guide angle $\beta$, the line 36 forms the bisector of the obtuse angle between the guide surface 4 and the support surface 50. Under this condition, and adjustment of the pressing edge 30 along the adjustment plane 36 leads to the same changes in distance between the plane 24 and the guide surface 4 on the one hand and the exit guide surface 26 and the support surface 50 on the other hand and consequently the exit guide passage for the severed board 22 is automatically adapted in its thickness to the cut board thickness. Certain deviations from the exact geometrical maintenance of these conditions may be admissible in practice. In the example of embodiment illustrated the adjustment angle is about 7°–8°.

Figures 2, 3:
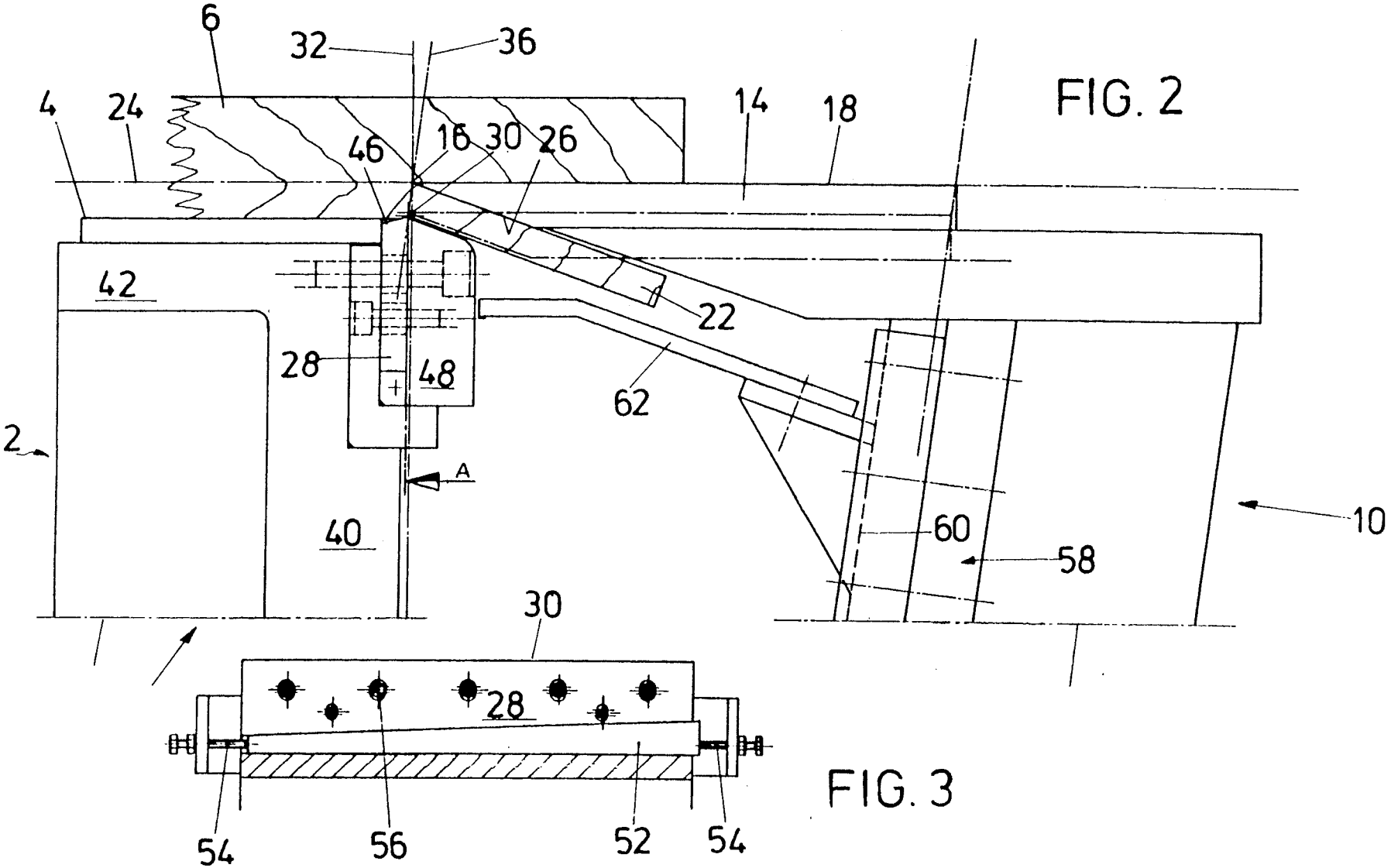
FIG. 2 is a corresponding arrangement in which the blade carrier is vertically adjustable in inclined direction.
FIG. 3 is a sectional view illustrating the vertical adjustability of the pressing edge.

Arranged under the component 28 carrying the pressing edge 30 is a wedge element 52. A view perpendicular to the plane of the drawing of FIG. 1 is shown in FIG. 3. At the ends of the wedge element 52 extending in the direction of the pressing edge 30 adjusting screws 54 are provided with which the wedge element 52 can be displaced in its longitudinal direction, thereby effecting a slight vertical adjustment of the pressure edge 30. The spindles or adjusting screws 50 could for example also be replaced by a hydraulic actuating cylinder engaging the wedge element 52. In the example of embodiment of FIG. 3 slot screw connections 56 are also indicated which are loosened for the vertical adjustment of the component 28 and after said adjustment must be tightened again in order to lock the component 28 with the pressing edge 30 firmly on the support table construction 2. With appropriate constraining guide means, for example dovetail guides, these screw connections could also be dispensed with.

From the above explanation it will be apparent that the apparatus for cutting severing of boards can be adjusted by a single machine adjustment by means of the vertical adjusting means 38 to practically all conditions of a modified board thickness. A relative adjustment of the pressing edge 30 with respect to the guide surface 4 is not necessary in every case and can if required be carried out in simple manner by displacement of the wedge element 52.

The arrangement of FIG. 2 differs from that of FIG. 1 only in that instead of the vertical adjusting means 38 in the support table construction 2 corresponding vertical adjusting means 58 having an inclined plane 60 are provided with the aid of which the blade 14 is now vertically adjustable along the adjustment plane 36, the adjustment plane extending through the blade cutting edge 16 but not necessarily extending through the pressing edge 30. The conditions are otherwise the same as in the embodiment of FIG. 1.

Both in FIG. 1 and in FIG. 2 a guide plate 62 for guiding the separated board 22 is also provided on the blade carrier construction 10.

The foregoing detailed disclosure is given for clearness of understanding only, and no unnecessary limitations should be understood therefrom, as modifications within the scope of the invention will be apparent to those skilled in the art.

We claim:

1. In an apparatus for cutting and severing a thin board from squared timber, comprising a guide surface along which longitudinally oriented squared timber can be advanced in a conveying direction;

a blade disposed behind the guide surface with respect to the conveying direction and having a blade cutting edge, said blade cutting edge being oriented at an angle to the conveying direction and disposed in a cutting plane located at a distance which may be varied from and parallel to the guide surface, said distance corresponding substantially to the thickness of the board to be severed;

a pressing edge disposed parallel to the blade cutting edge and to the guide surface and being disposed at an end of the guide surface facing the blade cutting edge; and adjusting means for varying the distance between the guide surface and said cutting plane;

the improvement wherein the adjusting means effects a displacement of one of the blade cutting edge and the pressing edge in an adjustment plane defining an acute adjustment angle ($\alpha$) with a line disposed normal to the guide surface, the blade cutting edge remaining parallel to the pressing edge.

2. The improvement according to claim 1 wherein the adjustment plane is disposed parallel to a plane containing the blade cutting edge and the pressing edge.

3. The improvement according to claim 1 wherein the adjustment angle ($\alpha$) lies in the range from about 3° to about 15°.

4. The improvement according to claim 3 wherein the adjustment angle ($\alpha$) lies in the range from about 5° to about 12°.

5. The improvement according to claim 1 wherein the blade is fixed to a frame and the guide surface is adjustable relative thereto.

6. The improvement according to claim 1 wherein the guide surface is fixed to a frame and the blade is adjustable relative thereto.

7. The improvement according to claim 1 wherein the pressing edge is vertically adjustable relative to the guide surface.

8. The improvement according to claim 7 wherein the pressing edge is mounted on a wedge element, both the pressing edge and the wedge element being disposed in a longitudinal direction, the pressing edge being vertically adjustable by a relative longitudinal displacement between the pressing edge and the wedge element.

9. In an apparatus for cutting and severing a thin board from squared timber, comprising a guide surface along which longitudinally oriented squared timber can be advanced in a conveying direction;

a blade disposed behind the guide surface with respect to the conveying direction and having a blade cutting edge, said blade cutting edge being oriented at an angle to the conveying direction and disposed in a cutting plane located at a distance which may be varied from and parallel to the guide surface, said distance corresponding substantially to the thickness of the board to be severed;

a pressing edge disposed parallel to the blade cutting edge and to the guide surface and being disposed at an end of the guide surface facing the blade cutting edge; and adjusting means for varying the distance between the guide surface and said cutting plane;

the improvement wherein the adjusting means effects a displacement of one of the blade cutting edge and the pressing edge in an adjustment plane defining an acute adjustment angle ($\alpha$) with a line disposed normal to the guide surface, the blade cutting edge remaining parallel to the pressing edge and further comprising an exit guide surface originating from the blade cutting edge and being adapted for carrying away a cut-off board, said exit guide surface defining an acute exit guide angle ($\beta$) with the cutting plane and wherein a support surface disposed behind the pressing edge with respect to the conveying direction, extends substantially parallel to the exit guide surface and together with said exit guide surface forms a channel for carrying away a cut-off board, the distance between the exit guide surface and the support surface being at least substantially equal to the distance between the guide surface and the cutting plane and the adjustment angle ($\alpha$) being substantially half the exit guide angle ($\beta$).

10. The improvement according to claim 9 wherein said distance between the exit guide surface and the support surface is slightly greater than the distance between the guide surface and the cutting plane.

11. In an apparatus for cutting and severing a thin board from squared timber, comprising a guide surface along which longitudinally oriented squared timber can be advanced in a conveying direction;

a blade disposed behind the guide surface with respect to the conveying direction and having a blade cutting edge, said blade cutting edge being oriented at an angle to the conveying direction and disposed in a cutting plane located at a distance which may be varied from and parallel to the guide surface, said distance corresponding substantially to the thickness of the board to be severed;

a pressing edge disposed parallel to the blade cutting edge and to the guide surface and being disposed at an end of the guide surface facing the blade cutting edge; and adjusting means for varying the distance between the guide surface and said cutting plane;

the improvement wherein the adjusting means effects a displacement of one of the blade cutting edge and the pressing edge in an adjustment plane defining an acute adjustment angle ($\alpha$) with a line disposed normal to the guide surface, the blade cutting edge remaining parallel to the pressing edge and wherein the adjustment plane substantially includes the blade cutting edge and the pressing edge.

* * * * *